United States Patent [19]

Johnson

[11] 4,435,871

[45] Mar. 13, 1984

[54] CLEANER FOR A TUBULAR WICK

[76] Inventor: Orville O. Johnson, 4011 S. Shady La., Eveleth, Minn. 55734

[21] Appl. No.: 341,510

[22] Filed: Jan. 21, 1982

[51] Int. Cl.[3] ..... B08B 1/00

[52] U.S. Cl. ..... 15/104 R; 15/236 R; 30/164.8

[58] Field of Search ..... 15/104 R, 104.05, 104.16, 15/236; 30/164.8, 366, 445, 446; 432/75; 134/8; 431/121-123

[56] References Cited

U.S. PATENT DOCUMENTS 476,052 5/1892 Loftus et al. ..... 30/164.8 X
1,299,210 4/1919 Myers ..... 30/366
1,699,970 1/1929 Jacques ..... 30/164.8
3,414,925 12/1968 Stavros ..... 15/104 R

*Primary Examiner*—Edward L. Roberts
*Attorney, Agent, or Firm*—Wicks & Nemer

[57] ABSTRACT

A cleaner for a tubular wick is shown according to the teachings of the present invention including an upper and lower circular plate. The lower plate includes a multiplicity of spaced holes formed through the plate adjacent the periphery thereof. A pin having a head is extended through each hole with the head upon the top surface of the lower plate. The upper plate is secured upon the top of the lower plate and upon the heads of the pins. A handle is secured upon the top of the upper plate.

5 Claims, 4 Drawing Figures

CLEANER FOR A TUBULAR WICK

SUMMARY

The invention relates broadly to oil burning heaters and the like having wicks for the same and more specifically to a cleaner for a tubular wick.

In the use of an oil burning heater having a tubular wick, the wick accumulates carbon on the upper edge which reduces the efficiency of the wick in the burning thereof. It is therefore an object of the invention to provide a cleaner for a tubular wick which easily and efficiently cleans the wick or carbon. It is a further object of the invention to provide a tubular wick cleaner having a multiplicity of spaced and pointed pins arranged on a support in circular formation substantially the circumference of the wick to be cleaned. To clean a tubular wick, all of the points of the pins are inserted into the top edge of the wick and rotated slightly whereby carbon on the wick is loosened for easy removal.

The invention will appear more clearly from the following detailed description when taken in connection with the accompanying drawings, showing by way of example a preferred embodiment of the inventive idea wherein like numerals refer to like parts throughout.

In the drawings forming part of this application:

Figure 1:
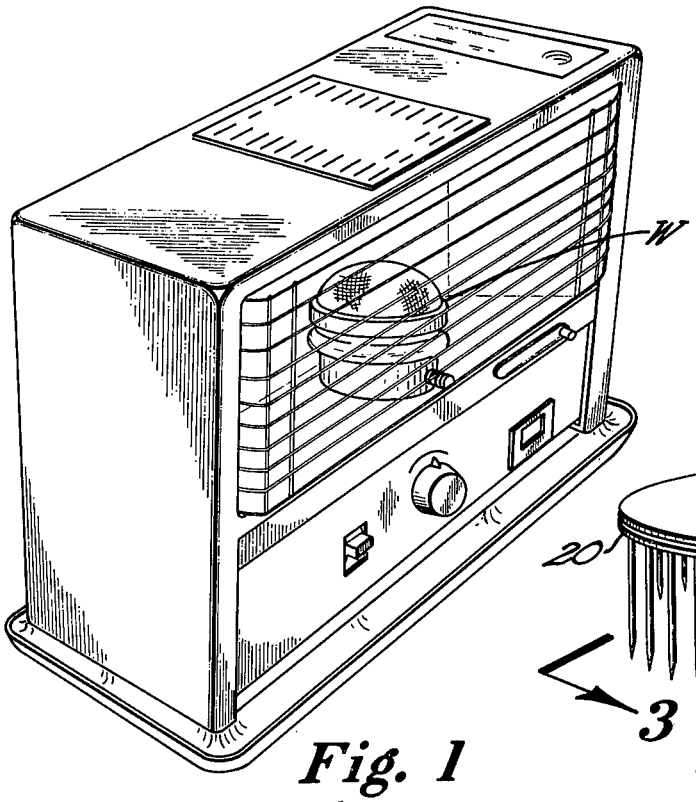
FIG. 1 is a perspective view of an oil heater which utilizes a tubular wick with which the wick cleaner embodying the invention is used to clean the wick.
Figure 2:
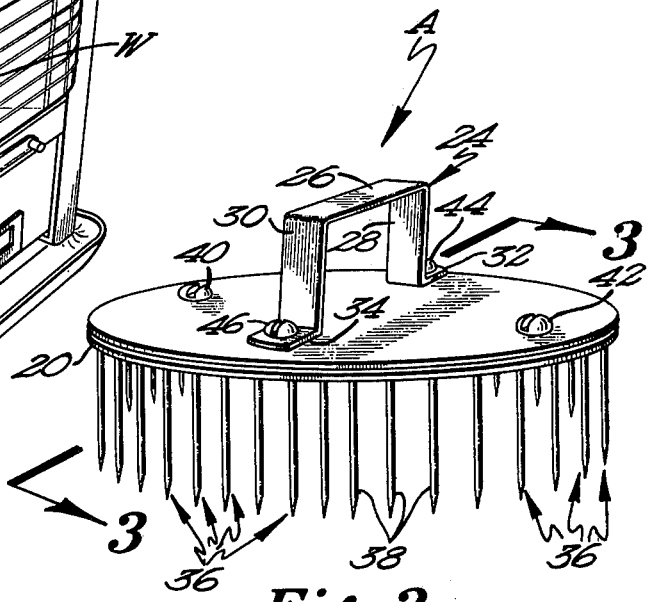
FIG. 2 is a perspective view of the wick cleaner.
Figure 4:
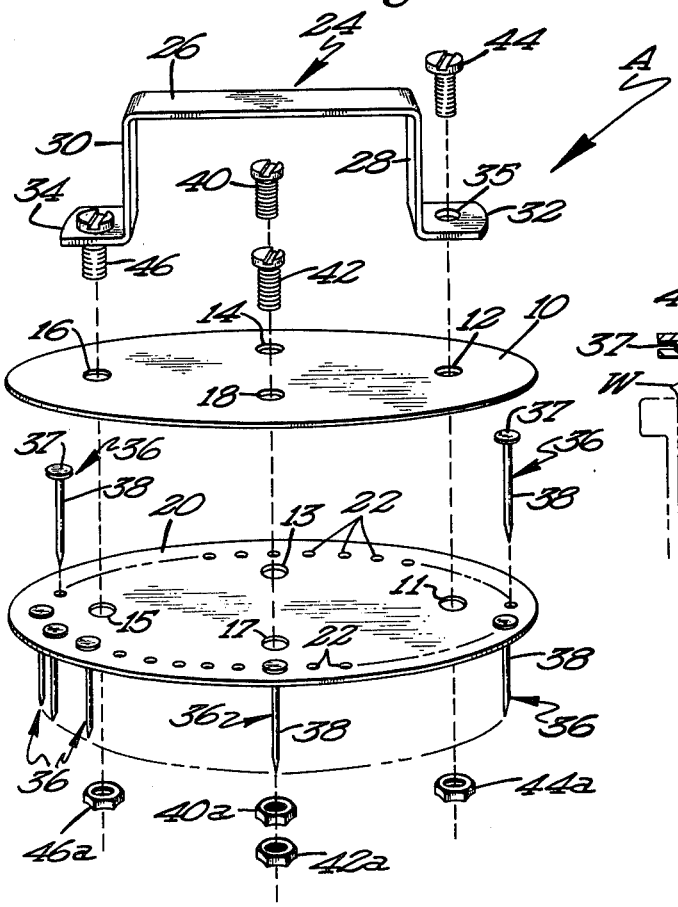
FIG. 4 is an exploded perspective view of the wick cleaner.
Figure 3:
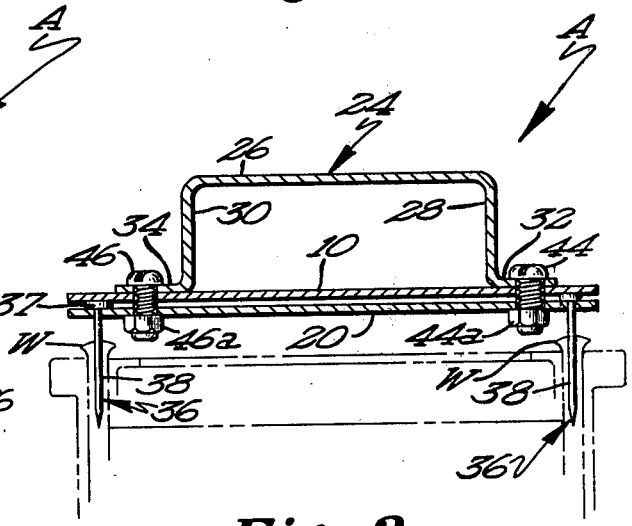
FIG. 3 is a sectional view on the line 3—3 of FIG. 2 with the wick housing in phantom.

Referring to the drawings in detail, the wick cleaner A includes a flat support including the upper base plate portion 10 which is flat and circular in formation and formed with the spaced holes 12, 14, 16 and 18. Further provided is the lower base plate portion 20 which is formed with a series of spaced holes 22 spaced slightly inwardly of the periphery of the plate portion 20. The base plate portion 20 also includes the spaced holes 11, 13, 15 and 17 which correspond with holes 12, 14, 16 and 18 of the upper plate portion.

The numeral 24 designates a handle which includes the straight top portion 26 that terminates at one end in the right angular leg 28 and at the other end in the right angular leg 30. The leg 28 terminates in the right angular flange 32, and the leg 30 terminates in the right angular flange 34. Each flange 32 and 34 is formed with a hole 35.

Additionally included is the series of pins 36 each including the pointed shank portion 38 with the flat head 40 on the opposite end. Further provided are the nut-equipped bolts 40 and 42 and the bolts 44 and 46.

The wick cleaner A is assembled as follows: a pin 36 is inserted through each of the holes 22 in plate 20 with the head upon the top surface of the plate. The upper plate 10 is then positioned upon the lower plate 20 with the holes 12, 14, 16 and 18 of plate 10 in alignment with holes 11, 13, 15 and 17, respectively, of lower plate 20. Next, the handle 24 is positioned upon top of plate 10 with the holes 35 of the flanges 32 and 34 in alignment with holes 12 and 11 and holes 16 and 15, respectively. Then bolt 44 is inserted through holes 35, 12 and 11 and secured with the nut 44*a* upon plate 20. Further, the bolt 46 is inserted through hole 35 of flange 34, hole 16 and hole 15 and secured with the nut 46*a* upon plate 20. Bolt 40 is then extended through hole 14 and hole 13 and secured with nut 40*a* upon plate 20, and bolt 42 is extended through hole 18 and hole 17 and secured with nut 42*a* upon plate 20.

The wick cleaner A is used by grasping the handle 24 and manipulating the cleaner so that the pins 36 are inserted into the top carbonized portion of a wick W at least partially. The cleaner is then rotated slightly which loosens the carbon which may be easily removed from the wick.

Having thus described the invention, what is claimed as new and desired to be secured by Letters Patent is:

1. A cleaner for loosening accumulated carbon on the top edge of a tubular wick, with the tubular wick having a diameter, comprising, in combination: a circular support having a circular periphery and an annular area adjacent to the periphery, means extending from the annular area adjacent the periphery of the support for at least partial insertion into the carbonized top edge of the tubular wick at a multiplicity of equally spaced locations around the tubular wick and for loosening the carbon when the support is rotated slightly, with the insertion and loosening means comprising: a multiplicity of pointed elements including a pointed shank portion, and means for connecting said pointed elements to said support in an equally spaced relation and in a single circular formation in the annular area of the circular support for engagement into the top edge of the tubular wick, with the annular area of the circular support having a diameter substantially equal to the diameter of the tubular wick, and with the annular area of the support defining an inner, central circular area of the circular support having a diameter slightly less than the diameter of the tubular wick, with the inner, central circular area of the circular support being free of any pointed elements or other protrusions.

2. The device of claim 1 in which said support includes a flat plate.

3. The device of claim 2 in which said pointed elements are pins.

4. The device of claim 1 in which said pointed elements are pins.

5. The device of claim 1 in which said cleaner is further characterized by (a) said support including an upper plate and
(b) a lower plate,
(c) said pointed elements are pins each
(d) having a head with a pin extended through
(e) a hole in said lower plate with the pin heads upon the top surface of the lower plate and
(f) means securing said upper plate upon said pin heads and said lower plate.

* * * * *